United States Patent [19]

Takahashi et al.

[11] Patent Number: 4,670,081

[45] Date of Patent: Jun. 2, 1987

[54] HANDLING MACHINE FOR DEPOSIT ENVELOPES

[75] Inventors: Kiyotaka Takahashi, Muko; Kathuhiko Arimoto, Omihachiman, both of Japan

[73] Assignee: Omron Tateisi Electronics Co., Kyoto, Japan

[21] Appl. No.: 737,070

[22] Filed: May 23, 1985

[30] Foreign Application Priority Data

May 29, 1984 [JP] Japan ..... 59-110474

[51] Int. Cl.[4] ..... B65C 9/02; B65C 9/34; B65C 9/46

[52] U.S. Cl. ..... 156/384; 156/364; 156/542; 156/555; 156/584; 156/DIG. 25; 156/DIG. 33; 156/DIG. 41; 156/DIG. 47; 198/416; 198/627; 271/249; 271/254

[58] Field of Search ..... 156/364, 361, 384, 542, 156/555, 584, DIG. 25, DIG. 33, DIG. 40, DIG. 41, DIG. 47, 554, 363; 198/627, 416; 271/240, 249, 254, 273

[56] References Cited

U.S. PATENT DOCUMENTS

| | | | |
|---|---|---|---|
| 3,182,994 | 5/1965 | Huth | 271/240 |
| 3,540,970 | 11/1970 | Huntwork | 156/364 |
| 3,800,679 | 4/1974 | Bartelheimer | 156/363 |
| 4,228,994 | 10/1980 | Volpe | 271/250 |
| 4,314,869 | 2/1982 | Crankshaw | 156/364 |
| 4,321,103 | 3/1982 | Lindstrom et al. | 156/364 |
| 4,435,243 | 3/1984 | Azeez et al. | 156/361 |
| 4,607,831 | 8/1986 | Raybuck | 271/240 |

FOREIGN PATENT DOCUMENTS

| | | |
|---|---|---|
| 0103652 | 3/1984 | European Pat. Off. . |
| 786014 | 8/1935 | France . |
| 3205463 | 9/1982 | Netherlands . |
| 2076167 | 11/1981 | United Kingdom . |

*Primary Examiner*—Michael Wityshyn

*Attorney, Agent, or Firm*—Stevens, Davis, Miller & Mosher

[57] ABSTRACT

A handling machine for deposit envelopes includes a delivery device for carrying inserted deposit envelopes along a delivery path, a printer for printing deposit information on one side of a succession of labels, the other sides of which contain an adhesive, a label feed device for supplying the printed labels at a given place along the delivery path, and members for sandwiching under pressure therebetween the labels fed to the delivery path and the carried deposit envelopes to stick the labels to the deposit envelopes.

2 Claims, 4 Drawing Figures

HANDLING MACHINE FOR DEPOSIT ENVELOPES

BACKGROUND OF THE INVENTION

This invention relates to a handling machine for deposit envelopes to be built within an envelope-depositing machine for processing bank notes, securities, cards, etc., in a state where they are enclosed in the envelopes, the envelope-depositing machine being one of the automatic deposit machines or automated teller machines installed and used in financial facilities such as banks. More particularly, this invention pertains to a machine for presenting to the inserted deposit envelopes deposit information peculiar thereto. It is herein to be understood that the wording "deposit envelope(s)" refers to an envelope or envelopes (or the like) in which bank note, securities, cards and other materials to which some value is added is or are enclosed, and which are used to deposit their contents in the banking facilities.

In order to identify the envelopes inserted or deposited in the envelope-depositing machine, it is required to add thereto some deposit information such as deposit dates, receipt numbers and names of banks and, if necessary, ID codes of users and values of their contents. In the conventional envelope-depositing machine, the deposit information is printed directly on one side of the deposit envelopes with the use of a printer. However, this manner of printing poses problems. One problem is that once the deposit envelopes are delivered to the printing position, the delivery operation should be interrupted. Printing of the deposit information in a state where the envelopes were kept stationary is time-consuming, and results in an extension of the time required for the overall deposit processing. Another is that, since the valuables mentioned above are enclosed in the deposit envelopes, they often become irregular on the surfaces and soft. The deposit envelopes also differ in thickness from each other. Thus, driect printing of the deposit information on the surfaces of the deposit envelopes by means of a printer, in many cases, results in unclear printed information. Printing per se may be impossible in some cases.

SUMMARY OF THE INVENTION

An object of this invention is to provide a handling machine for deposit envelopes, by which clear deposit information can rapidly be given to the deposit envelopes.

The handling machine for deposit envelopes according to this invention is characterized by including means for carrying the inserted deposit envelopes along a delivery path, means for printing deposit information of labels, means for supplying onto a given place of the delivery path the labels having the deposit information printed on one side and adhesives applied on the other side, and means for sandwiching under pressure therebetween the labels fed onto the delivery path and the deposit envelopes carried to stick the labels to the deposit envelopes. Preferably, means for controlling the attitude of the deposit envelopes carried with respect to the delivery direction is mounted in the delivery path.

Clear printing is achieved, since the deposit information for the inserted envelopes is printed to labels. The labels having the deposit information printed thereto are stuck to the deposit envelopes being carried. This dispenses with any stationary holding of the deposit envelopes, so that addition of the deposit information to the envelopes is rapidly effected. Furthermore, since the deposit envelopes and the labels are retained under pressure between the sandwiching means, it is assured that the labels are stuck to the deposit envelopes, even when the deposit envelopes are of slight irregularity, or are soft. Since the deposit envelopes are controlled on the delivery path in respect of their attitude with respect to the delivery direction, it is always assured that the labels are stuck to same place of the envelopes, and are applied to the deposit envelopes of different sizes.

BRIEF DESCRIPTION OF THE DRAWINGS

Preferred embodiments of the invention—illustrative of the best mode in which applicant has contemplated applying the principles—are set forth in the following description and shown in the drawings and are particularly and distinctly pointed out and set forth in the appended claims.

DETAILED EXPLANATION OF THE PREFERRED EMBODIMENTS

In the embodiment to be described below, this invention is applied to an envelope-depositing machine.

Figure 1:
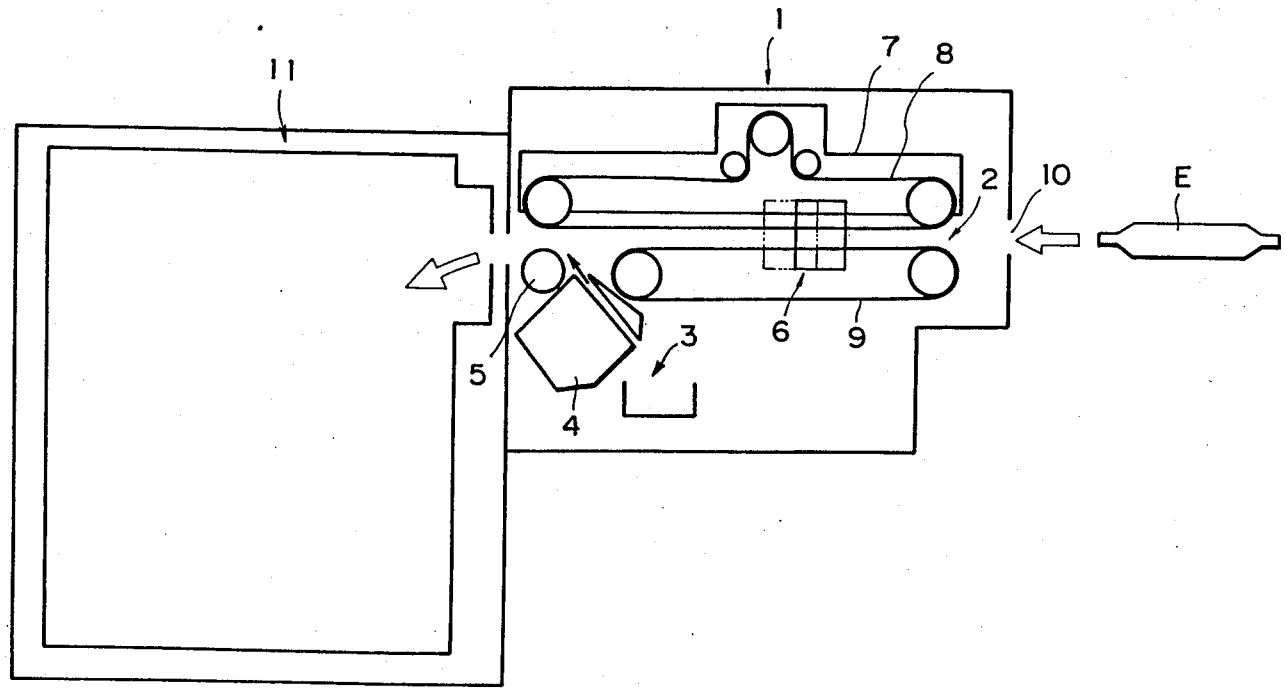
FIG. 1 schematically shows the construction of the envelope depositing machine.

Referring to FIG. 1, the envelope-depositing machine is comprised of an envelope-handling machine 1 for giving deposit information to a deposit envelope E supplied into an inlet 10, and an envelope-accommodating device 11 for accommodating deposit envelopes, the processing of which is completed. The envelope-handling machine 1 includes a delivery device or a conveyor 2 for carrying the deposit envelope from the inlet 10 to the device 11, a printer 4 for printing the deposit information regarding the envelope supplied through the inlet 10 to one side of a label, a label feed device 3 for feeding on a delivery path of the delivery device 2, the label having the deposit information printed to one side and adhesives applied on the other side, an attitude control device 6 for allowing the center of the envelope to be in alignment with the center of the delivery path in the course of delivery and directing the envelope in the direction of delivery, and a roller 5 for sticking the fed label to the lower side of the carried envelope. The envelope to which the label is applied is fed into the accommodation device 11. The delivery device 2 includes upper belts 8 and lower belts 9, and is designed to carry the envelope, while it is sandwiched therebetween. The upper belts 8 are mounted on a supporting device 7, which is held for up and down movement.

Figure 2:
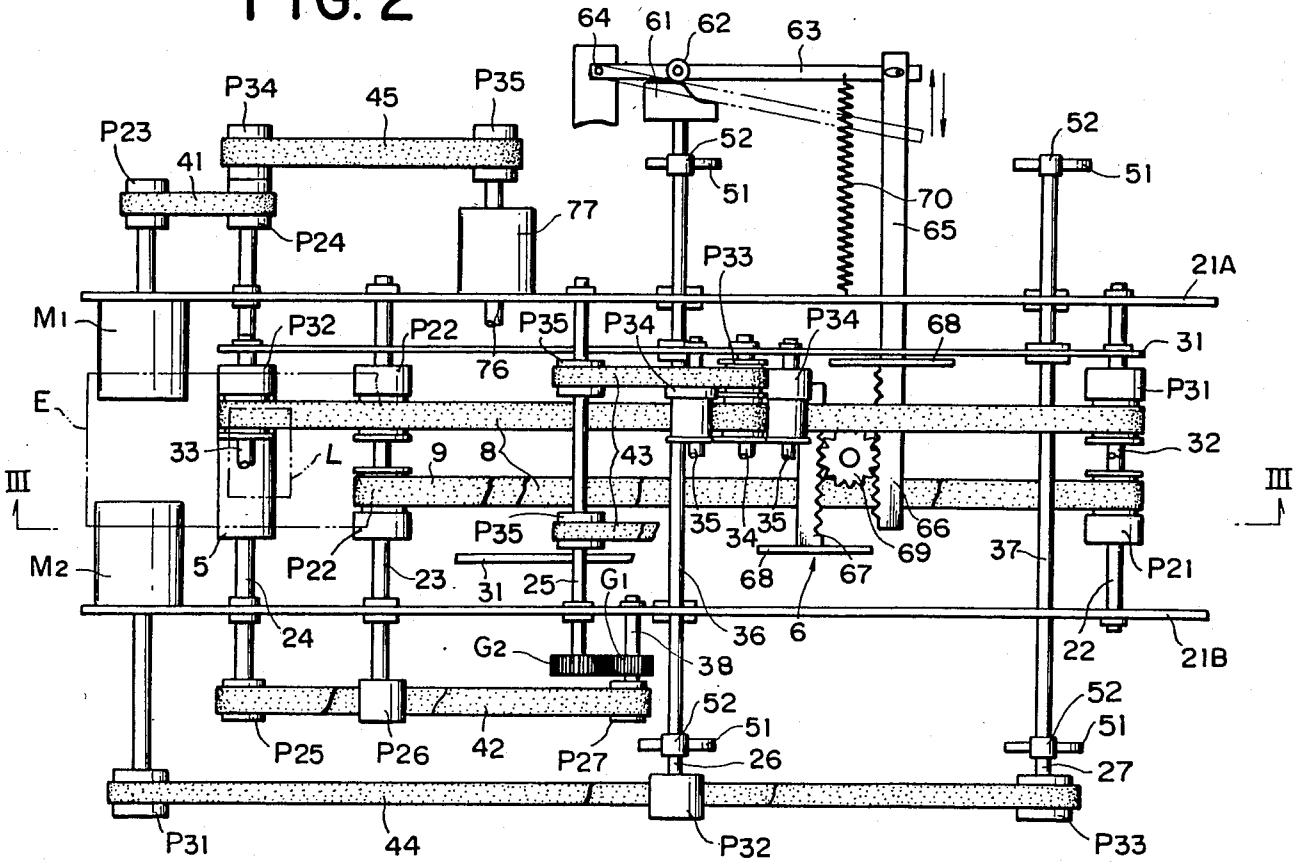
FIG. 2 is a plan view showing the deposit envelope-handling machine, which is partly cut out.
Figure 3:
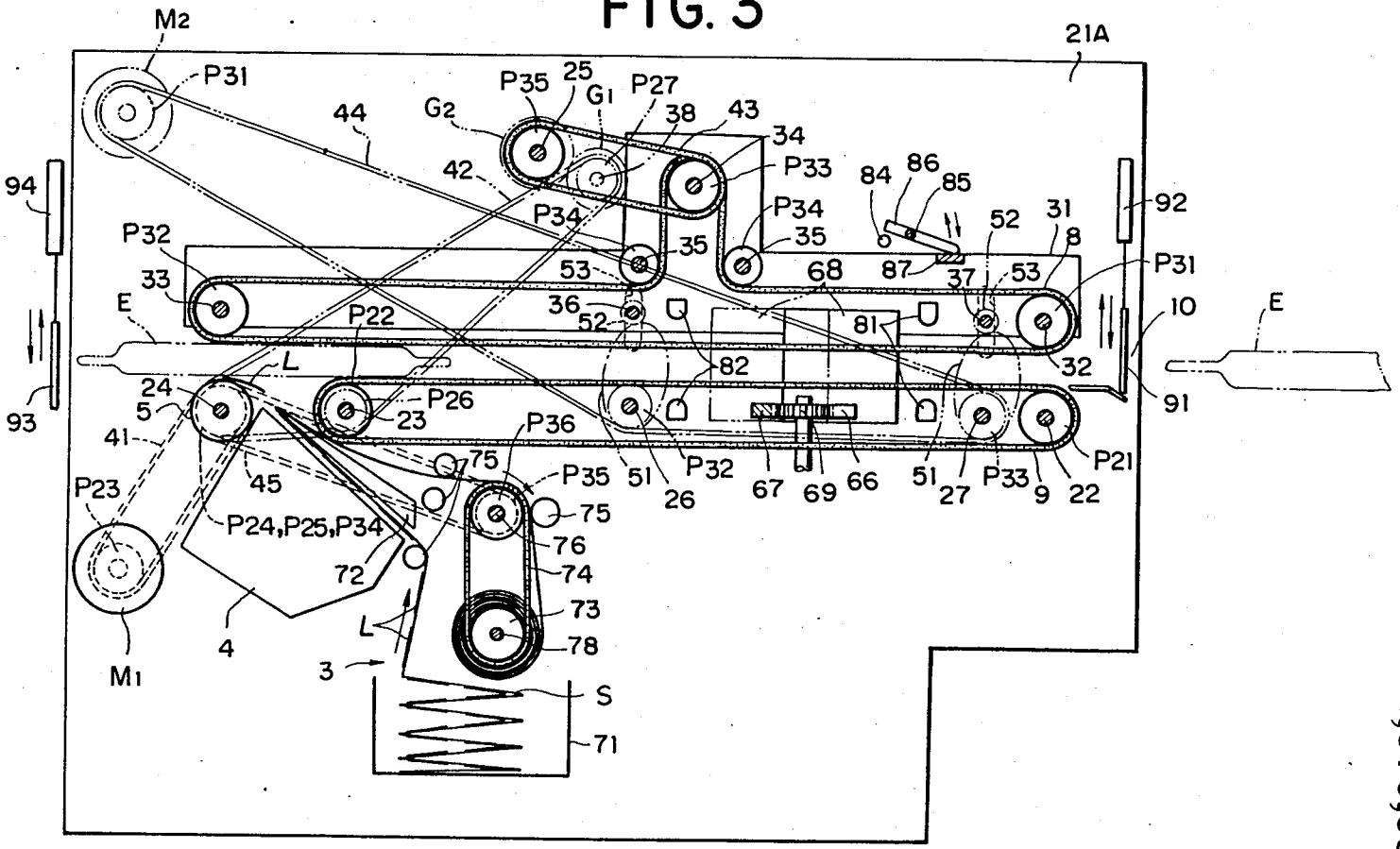
FIG. 3 is a sectional view taken along the line III—III in FIG. 2.

Referring to FIGS. 2 and 3, the envelope handling machine 1 is provided with a pair of frames 21A and 21B which are interconnected with each other at a suitable interval by means of a connecting member (not illustrated). Between the frames 21A and 21B, there are rotatably supported rotary shafts 22, 23, 24, 25, 26 and 27. The rotary shaft 22 located in a position close to the inlet 10 is fixedly provided with two pulleys $P_{21}$, and the rotary shaft 23 located opposite thereto is fixedly provided with two pulleys $P_{22}$. Between and around the pulleys $P_{21}$ and $P_{22}$, there are wrapped the lower belts 9.

The roller 5 is fixed to the rotary shaft 24 located further in front of the rotary shaft 23, as viewed in the direction of delivery.

Between the frames 21A and 21B, there are positioned a pair of elevating plates 31 included in the supporting device 7, which are also interconnected with each other at a suitable interval by means of a connecting member (not illustrated). The elevating plates 31 are adapted to be guided by guide members (not shown) for up and down movement, and supported by cams 51 and cam followers 52, which will both be described later. Between the elevating plates 31, there are positioned rotary shafts 32, 33, 34 and 35, which are rotatably supported in place. Supporting shafts 36 and 37 are fixed between the elevating plates 31. The rotary shafts 32 and 33 are fixedly provided with two pulleys $P_{31}$ and $P_{32}$, respectively, the upper belts 8 being wrapped around pulleys $P_{31}$ and $P_{32}$ and engaged therewith. The pulley $P_{32}$ and the roller 5 face each other vertically. The rotary shafts 34 and 35 are provided with pulleys $P_{33}$ and $P_{34}$, and a portion of the belts 8 projects upwardly beyond the pulleys $P_{34}$ into engagement with the pulleys $P_{33}$.

A delivery motor M1 of the delivery device 2 is fixed to the frame 21A. The rotary shaft 24 extends outwardly of the both frames 21A and 21B, and is fixedly provided at both its ends with pulleys $P_{24}$ and $P_{25}$. There is a portion of the rotary shaft 23 extending outwardly of the frame 21B, at which a pulley $P_{26}$ is fixed. The frame 21B supports rotatably at a portion somewhat above its central portion an outwardly extending rotary shaft 38, to which a pulley $P_{27}$ and a gear $G_1$ are fixed. The rotary shaft 25 is fixedly provided with two pulleys $P_{35}$. A portion of the rotary shaft 25 extends outwardly of the frame 21B, and is provided wtih a gear $G_2$ to mesh with the gear $G_1$. A belt 41 is wrapped around the pulley $P_{23}$ fixed to the output shaft of the motor M1 and the pulley $P_{24}$ of the rotary shaft 24. A belt 42 is wrapped around the pulleys $P_{25}$, $P_{26}$ and $P_{27}$. Furthermore, belts 43 are also wrapped around the pulleys $P_{35}$ and $P_{33}$. The aforesaid arrangement causes the upper and lower belts 8 and 9 and the roller 5 to be driven in synchronism by the motor M1.

Both ends of the rotary shaft 26 extend outwardly of the frames 21A and 21B, and are fixedly provided with oval cams 51. Similarly, both ends of the rotary shaft 27 are fixedly provided with cams 51. The shafts 26 and 27 are fixedly provided with pulleys $P_{32}$ and $P_{33}$ at the ends projecting outwardly of the frame 21B. A motor M2 is designed to drive the elevating plate 31 having the upper belts 8 for up and down movement, and is mounted on the frame 21B with the output shaft being provided with a pulley $P_{31}$. A belt 44 is wrapped around the pulleys $P_{31}$, $P_{32}$ and $P_{33}$. On the other hand, the elevating plates 31 include supporting shafts 36 and 37, which project outwardly of the elevating plates 31, and extend further outwardly of the frames 21A and 21B through vertically elongate openings 53 formed on the frames 21A and 21B. The supporting shafts 36 and 37 are provided at both ends with cam followers 52, which rest on the peripheral edges of cams 51. Consequently, the rotary shafts 26 and 27 as well as the cams 51 are rotated through a belt 44 by driving the motor M2, and the elevating plates 31 (the supporting device 7) are moved up and down by up and down movement of the cam followers 52 resting on the cams 51. As a result, the upper belts 8 are lifted up and down, and are thus moved toward and away from the lower belts 9.

The attitude control device 6 for the deposit envelopes includes positioning plates 68, which are each fixed to one ends of racks 66 and 67. The racks 66 and 67 mesh with each other through an associated pinion 69. The positioning plates 68 are located outside of the upper and lower belts 8 and 9 and are at the same height position as a delivery path defined by the upper and lower belts 8 and 9. A lever 65 extends outwardly from one rack 66 through an opening formed in the frame 21A. The lever 65 is provided in the outer end with an elongate opening, into which a pin formed at one end of a lever 63 is fitted so as to connect the levers 65 with 63. The lever 63 is pivotally fixed at the other end to a mounting member fixed to the frame 21A. In the vicinity of the other end of the lever 63, there is a cam follower 62. On the other hand, there is a cam 61 mounted at the end of the rotary shaft 26, which extends outwardly from the frame 21A. The lever 63 is energized by a tension spring 70 so as to allow the cam follower 62 to constantly contact the cam surface of the cam 61. The racks 66 and 67 are supported by the associated supporting members (not illustrated) for longitudinal movement, while the pinion 69 is rotatably supported by the associated supporting member (not shown).

Driving of the Motor M2 causes rotation of the rotary shaft 26 to move the cam follower 62 along the cam 61 and move the rack 66 in its longitudinal direction through the levers 63 and 65. Movement of the rack 66 is transmitted to the other rack 67 through the pinion 69. As mentioned above, driving of the motor M2 causes up and down movement of the elevating plates 31 through the cams 51 and the cam followers 52. The racks 66 and 67 are driven in such a manner that, when the elevating plates 31 ascend, the positioning plates 68 move toward each other.

The label feed device 3 is equipped with a storing box 71, a peeling and guiding plate 72 disposed in opposition to the printer 4, a support sheet take-up roller 73, a pulley $P_{36}$ and auxiliary rollers 75 disposed at suitable positions. A pulley $P_{34}$ is fixed to the rotary shaft 24 driven by the driving motor M1. An input shaft of a clutch 77 secured to the frame 21A is also fixedly provided with a pulley $P_{35}$, and a belt 45 is wrapped around the pulleys $P_{34}$ and $P_{35}$. The pulley $P_{36}$ is fixed to the output shaft 76 of the clutch 77. The roller 73 is secured to a rotary shaft 78 rotatably interposed between the frames 21A and 21B, and a belt 74 is wrapped around the pulley $P_{36}$ and a portion of the roller 73. The guiding plate 72 is obliquely disposed with its end portion being gradually decreased in thickness and being located between the roller 5 and the pulley $P_{22}$. Labels L have pressure-sensitive adhesives applied on one side thereof, which are adhered to a support sheet S at regular intervals. A portion of the support sheet S having labels L is within the storing box 71, and the support sheet S passes between the guiding plate 72 and the printer 4, is turned down at the leading end of the guiding plate 72, passes through the pulley $P_{36}$, and is wound around the roller 73.

When the leading end of the envelope E carried on the delivery path defined between the belts 8 and 9 approaches the vicinity of the roller 5, the clutch 77 is actuated to drive the roller 73, whereby winding-up of the support sheet S is initiated. The label L, to which deposit information has already been printed by the printer 4, is fed toward leading end of the guiding plate 72, as winding-up of the support sheet S proceeds. When a portion of the support sheet S having the label L is turned down at the leading end of the guiding plate 72, such label L is peeled out of the support sheet S, and is fed in between the envelope E and the roll 5. Since the envelope E and the label L are sandwiched under pressure (or clamped) between the roll 5 and the pulleys $P_{32}$ and the belts 8, the label L is adhered to the lower side of the envelope E through the pressure-sensitive adhesives.

Figure 4:
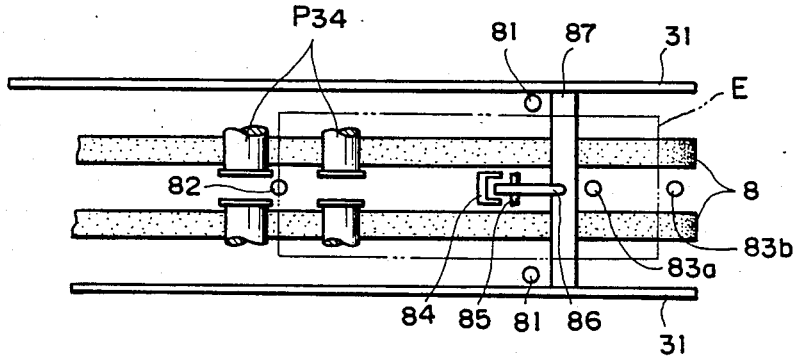
FIG. 4 is a plan view showing the arrangement of various sensors.

In order to inhibit entrance of any oversized or undersized envelope, provision is made of thickness, length and width sensors. Referring to FIG. 4, the thickness sensor is comprised of a lever 86 pivotally fixed to a shaft 85 interposed between the frames 21A and 21B, an operable member 87 adapted to terminate within the elevating plates 31 and receive one end of the lever 86, and a photosensor fixed to a mounting member mounted on the frames 21A and 21B for sensing the other end of the lever 86. The elevating plate 31 ascends to a certain height or more with ascent of the one end of the lever 86 and descent of the other end thereof, whereby the light passage of the photosensor 84 is cut off by the other end. Thus, the thickness of the envelope E is judged as being more than prescribed. The length sensor is comprised of photosensors 82, 83*a* and 83*b* arranged in such a manner that light passes vertically through the middle portion between the the left and right belts 8. Using the position of the sensor 82 as the reference, the sensor 83*a* is located in a position within the range of the allowed envelope's length, while the sensor 83*b* is located in a position spaced away therefrom by a length longer than the envelope's length. If the sensor 83*a* senses the envelope E and the sensor 83*b* does not, when the sensor 82 senses one end of that envelope, it is judged as having a suitable length, but, if it is not the case, it is judged as having an unsuitable length. The width sensor is comprised of left and right photosensors 81 which are disposed at places inside of the elevating plates 31 and in the vicinity thereof, and are arranged in such a manner that light passes vertically. Unless the sensors 81 sense the envelope E after it has been centered by the attitude control device 6, the envelope is then judged as having a suitable width.

In FIG. 3, shutters 91 and 93 each are provided in the position of the inlets 10 for envelopes and at the place where the envelopes are fed from the machine 1 into the device 11, respectively, the shutters being designed to be opened and closed by solenoids 92 and 94, respectively.

The envelope-handling machine 1 as constructed above operates in the following manner.

The driving motor M2 is driven by an initiation command from the envelope-depositing machine, whereby the elevating plates 31 ascend to hold the upper belts 8 in an ascending position. Then, the shutter 91 is also opened. Upon insertion of the envelope E into the inlet 10, this is sensed by an insertion-detecting sensor (not shown) disposed in the inlet 10. Thereupon, the motor M2 is again driven to lower the elevating plates 31. The cam 51 is rotated to an angular position which allows the cam followers 52 to be lowered to the lowermost position. The elevating plates 31 and the upper belts 8 are brought to a state where they are supported by the envelope E resting on the lower belts 9. Generally, the cam followers 52 are spaced away from the cams 51. As the motor M1 and hence the upper and lower belts 8 and 9 are driven, the envelope E is carried, while it is sandwiched between the upper and lower belts 8 and 9. If the envelope E has a thickness more than prescribed, the delivery motor M1 is reversed to return it to the inlet 10, since the signal to that effect is sent out of the thickness-detecting sensor. The same also holds for the case where the envelope E has a length more than prescribed.

The delivery motor M1 stops upon the envelope E being carried to the position of the attitude control device 6. The motor M2 is then driven to elevate the elevating plates 31. Some gap appears between the envelope and the upper belts 8. The positioning plates 68 are moved toward the center by driving of the motor M2 to push both sides of the envelope, whereby centering of the envelope is effected. The center of the envelope in the widthwise direction is in coincidence with that of the delivery path in the widthwise direction, while the longitudinal direction of the envelope is parallel with the delivery direction. At this time, the width of the envelope is also checked. If any, unsuitable envelopes are then returned.

The elevating plates 31 are again lowered, and the elevating plates 31 and the upper belts 8 rest and are supported on the envelope E. Then, the motor M1 is again driven, whereby the envelope is carried, while it is sandwiched or clamped between the both belts 8 and 9.

In the meantime, deposit information is printed on the surface of the next label L on the support sheet S on the basis of the data sent from the envelope-depositing machine. Upon the leading end of the envelope reaching above the printer 4, the clutch is then put in operation, so that initiation of rolling of the support sheet S around the roll 73 takes place. In operative association of rolling-up of the support sheet S, the label L having deposit information printed thereon is fed toward the leading end of the guide plate 72, and is peeled from the support sheet S, as mentioned in the foregoing. While the label L peeled from the support sheet S moves along the lower side of the envelope E, the envelope with the label L is sandwiched under pressure between the pulleys $P_{32}$ and upper belts 8 and the roller 5, whereby the label L is stuck to the envelope E. Thereafter, the shutter 93 is opened to feed the envelope with the label L attached thereto into the envelope-accommodating device 11.

What is claimed is:

1. A handling machine for inserted deposit envelopes, comprising:

means for carrying deposit envelopes along a delivery path, said means including lower delivery belts, and upper delivery belts designed to be driven in synchronism with the lower belts and supported for up and down movement relative to the lower delivery belts, means disposed in the delivery path for controlling the attitude of deposit envelopes with respect to a delivery direction, said controlling means including positioning plates disposed at both sides of the delivery path, and a mechanism for causing said positioning plates to be simultaneously moved toward or away from each other in the width direction of the delivery path, means for driving said upper delivery belts of said carrying means and said mechanism in an operatively cooperative manner so that when said upper delivery belts move upwardly, said positioning plates move toward each other to cause deposit envelopes to be positioned at a center of the delivery path in width and directed in parallel with the delivery direction, means for printing deposit information on a first side of a plurality of labels, each having an adhesive on a second side thereof, means for feeding said labels to a location along said delivery path at a rear of said attitude control means, and means for sandwiching the labels fed to the delivery path and deposit envelopes transported by said delivery belts together to fasten the labels to the deposit envelopes.

2. The machine as defined in claim 1, in which said label feed means includes a peeling and guiding plate with a pointed leading end, and means for turning down a support sheet with the labels attached thereto at the leading end of said peeling and guiding plate.

* * * * *